US006927202B2

(12) United States Patent
Grainger et al.

(10) Patent No.: US 6,927,202 B2
(45) Date of Patent: Aug. 9, 2005

(54) FABRIC CONDITIONING COMPOSITIONS

(75) Inventors: David Stephen Grainger, Wirral (GB); Stephane Roth, Wirral (GB); Stephen Mark Ilett, Wirral (GB); Melinda Walker, Wirral (GB)

(73) Assignee: Unilever Home & Personal Care, USA division of Conopco, Inc., Greenwich, CT (US)

( * ) Notice: Subject to any disclaimer, the term of this patent is extended or adjusted under 35 U.S.C. 154(b) by 425 days.

(21) Appl. No.: 10/247,140

(22) Filed: Sep. 19, 2002

(65) Prior Publication Data

US 2004/0058848 A1 Mar. 25, 2004

(51) Int. Cl.[7] ..... C11D 1/645
(52) U.S. Cl. ..... 510/527; 510/515
(58) Field of Search ..... 510/515, 522, 510/527

(56) References Cited

U.S. PATENT DOCUMENTS

| | | | | |
|---|---|---|---|---|
| 4,439,335 | A | 3/1984 | Burns | |
| 4,963,274 | A | 10/1990 | Ruback et al. | |
| 5,501,806 | A | 3/1996 | Farooq et al. | |
| 5,643,865 | A * | 7/1997 | Mermelstein et al. | 510/521 |
| 5,877,145 | A | 3/1999 | Demeyere et al. | |
| 2001/0036909 | A1 * | 11/2001 | Levinson | 510/327 |

FOREIGN PATENT DOCUMENTS

| | | |
|---|---|---|
| EP | 0 593 542 | 8/1996 |
| WO | 93/01265 | 1/1993 |
| WO | 95/16766 | 6/1995 |
| WO | 01/32813 | 5/2001 |

OTHER PUBLICATIONS

*Int'l Search Report No. PCT/EP 03/09185 dated Feb. 4, 2004, 3 pp.*

Friedli, F.E. et al., "Upgrading triethanolamine esterquat performance to new levels", *Jnl. of Surfactants and Detergents*, vol. 5, No. 3, pp 211–216 ( ).

* cited by examiner

*Primary Examiner*—John R. Hardee
(74) *Attorney, Agent, or Firm*—Ellen Plotkin

(57) ABSTRACT

A concentrated, aqueous fabric softening composition comprises (a) an ester-linked quaternary ammonium fabric softening material comprising at least one mono-ester linked component and at least one tri-ester linked component, the material being derived from fatty groups having an iodine value of from 0 to 3 and (b) an ester-linked quaternary ammonium fabric softening material comprising at least one mono-ester linked component and at least one tri-ester linked component, the material being derived from fatty groups having an iodine value of from 20 to 140 wherein the total amount of unsaturated monoester component of material (b) is from 4 to 20% by weight of the total amount of (a) and (b).

11 Claims, No Drawings

FABRIC CONDITIONING COMPOSITIONS

FIELD OF THE INVENTION

The present invention relates to fabric conditioning compositions, and in particular highly concentrated fabric conditioning compositions comprising an unsaturated and a saturated quaternary ammonium softening material.

BACKGROUND OF THE INVENTION

It is well known to provide liquid fabric conditioning compositions which soften in the rinse cycle.

Such compositions comprise less than 7.5% by weight of softening active, in which case the composition is defined as "dilute", from 7.5% to about 30% by weight of active in which case the compositions are defined as "concentrated" or more than about 30% by weight of active, in which case the composition is defined as "super-concentrated".

Concentrated and super-concentrated compositions are desirable since these require less packaging and are therefore environmentally more compatible than dilute or semi-dilute compositions.

A problem frequently associated with concentrated and superconcentrated compositions, as defined above, is that the product is not stable upon storage, especially when stored at high temperatures. Instability can manifest itself as a thickening of the product upon storage, even to the point that the product is no longer pourable.

The problem of thickening upon storage is particularly apparent in concentrated and superconcentrated fabric softening compositions comprising an ester-linked quaternary ammonium fabric softening material having one or more fully saturated alkyl chains.

However, it is desirable to use ester-linked compounds due to their inherent biodegradability and to use substantially fully saturated quaternary ammonium fabric softening compounds due to their excellent softening capabilities and because they are more stable to oxidative degradation (which can lead to malodour generation) than partially saturated or fully unsaturated quaternary ammonium softening compounds.

Of the types of ester-linked quaternary ammonium materials known, it is desirable to use those based on triethanolamine which produce at least some mono-ester linked component and at least some tri-ester linked component since the raw material has a low melting temperature which enables the manufacturing process of the composition to occur at low temperatures. This reduces difficulties associated with high temperature handling, transport and processing of the raw material and compositions produced therefrom.

Certain of the abovementioned problems have previously been addressed. For instance, it is known to inhibit thickening of concentrated and superconcentrated compositions by providing an electrolyte within the composition. However, electrolytes are known to have a destabilising influence on such compositions upon storage.

it has also been proposed in WO-A1-95/16766 to provide a stable highly concentrated fabric conditioning composition containing a mixed active system. A first component of the active system has an iodine value of less than 10 and a second component has an iodine value of from 20 to 100. On page 4 of the description, it is clearly stated that the first component must be at least 80% diester and less than 20% monoester. Furthermore, on page 2 it is taught that the second component is a structurally different material from the first component. This document only teaches that the presence of an unsaturated component enables formulation of fabric conditioning compositions having a higher concentration.

There is no teaching nor any disclosure of optimising the mono-ester content of the unsaturated component to further improve stability of highly concentrated compositions.

Furthermore, by introducing high levels of unsaturation into the formulation, the product can become liable to oxidative degradation, leading to rancid or fatty malodours forming on storage—particularly at high temperatures.

U.S. Pat. No. 4,439,335 discloses mixtures of quaternary ammonium materials, one of which is a di(amidoethyl) methyl quaternary ammonium salt and/or imidazolinium salt.

U.S. Pat. No. 5,501,806 also discloses mixtures of softening actives to achieve highly stable, highly concentrated systems. It discloses mixtures of components A and B at a total level of 25 to 50% by weight of active ingredient). In all examples and the claims, A is a mineral or organic acid salt of an amidoamine.

U.S. Pat. No. 4,963,274 discloses concentrated formulations comprising mixtures of active ingredients.

EP-B1-0593542 discloses on page 4 line 51 a mixture of Tetranyl AHT-1 and Tetranyl AT-1 in a ratio of 4:1. The combined mixture is present in an amount of 5% by weight.

Surprisingly, we have now found that a highly concentrated softening composition in which saturated and unsaturated softening species based on triethanolamine are present and in which the level of the softening components of the saturated species in the formulation (particularly the hardened di- and tri-esters components) are maximised whilst the amount of unsaturated species present is optimised to within a specific range provides excellent softening performance, reduced product malodour generation and reduced instability.

The disclosure of a mixture of saturated and unsaturated species in the prior art does not identify nor even suggest that by optimising the monoester species of the unsaturated material to within a particular range, significant benefits in terms of stability without loss of softening and odour control can be achieved.

OBJECTS OF THE INVENTION

The present invention seeks to overcome one or more of the problems and to provide one or more of the benefits desired by consumers mentioned above.

It is particularly preferred to provide a highly concentrated fabric conditioning composition which is aesthetically and pleasing to consumers, pourable, stable, and which provide good softening characteristics to fabrics.

STATEMENT OF INVENTION

Thus, according to the present invention, there is provided a concentrated, aqueous fabric softening composition comprising:

(a) an ester-linked quaternary ammonium fabric softening material comprising at least one mono-ester linked component and at least one tri-ester linked component, the material being derived from fatty groups having an iodine value of from 0 to 3; and (b) an ester-linked quaternary ammonium fabric softening material comprising at least one mono-ester linked component and at least one tri-ester linked component, the material being derived from fatty groups having an iodine value of from 20 to 140, wherein the total amount of unsaturated monoester component of material (b) is from 4 to 20% by weight of the total amount of (a) and (b).

The invention also provides a method of preparing a composition comprising material (a), (b) an aqueous carrier and an inorganic electrolyte comprising co-melting materials (a) and (b), adding the co-melted ingredients to a heated aqueous seat with low shear agitation, allowing the mixture to cool and adding an inorganic electrolyte to the cooled mixture.

DETAILED DESCRIPTION OF THE INVENTION

It has surprisingly been found that with mixtures of saturated and unsaturated quaternary ammonium materials based on triethanolamine, the amount of unsaturated species required to achieve acceptable viscosities can be lower than expected. Without being limited by the theory, it is believed that the ability of the unsaturated material to aid thinning of the composition and hence the manufacturing of highly concentrated formulations based principally on a saturated active material is related to the level of the monoester component of the unsaturated softening material.

Without wishing to be bound by theory, it is believed that when the level of the mono-ester species of the unsaturated quaternary ammonium material is too low, the phase volume or the composition is too high due to the high level of saturated quaternary ammonium material present and the composition thickens undesirably upon storage.

If the level of the mono-ester species is too high, softening performance is adversely affected, the composition becomes undesirably thin and the product can even flocculate.

Thus, within the range specified in the present invention, a desirable product can be achieved whilst avoiding one or more of the problems mentioned above.

In particular, unsaturated quaternary ammonium softening materials based on triethanolamine formulated to contain levels of the unsaturated mono-ester component within a particular range preferably provide compositions with excellent stability benefits without significantly adversely affecting the softening performance or odour.

Quaternary Ammonium Materials

The quaternary ammonium material comprises a mixture of at least one saturated and at least one unsaturated quaternary ammonium material.

The level of mono-ester component of the unsaturated softening material is within the range 4% to 20% by weight based on the total weight of softening materials present in the composition, more preferably 6 to 15%, most preferably 7 to 14%, e.g. 7.5 to 13%.

Both the unsaturated and the saturated materials are preferably represented by the following general formula:

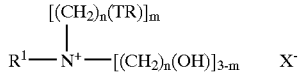

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group,

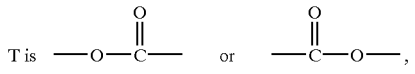

n is O or a number selected from 1 to 4, m is 1, 2 or 3 and denotes the number of moieties to which it relates that pend directly from the N atom, and $X^-$ is an anionic group, such as halides or alkyl sulphates, e.g. chloride, methyl sulphate or ethyl sulphate.

The saturated species is derived from a parent fatty acid or acyl compound having an iodine value of from 0 to 3, more preferably 0 to 2, most preferably 0 to 1.

Especially preferred materials within this class are di-alkyl esters of triethanol ammonium methyl sulphate. A commercial example of a compound within this formula is Tetranyl AHT-1 (di-hardened tallow ester of triethanol ammonium methyl sulphate 85% active), ex Kao corporation.

The unsaturated species is derived from a parent fatty acid or acyl compound having an iodine value of from 20 to 140, more preferably 25 to 100, most preferably 30 to 60.

Preferred materials within this class include the following from Terranyl series: AOT-1 (di-oleic ester of triethanol ammonium methyl sulphate 80% active), L1/90 (partially hardened tallow ester of triethanol ammonium methyl sulphate 90% active), all supplied by Kao corporation. Other unsaturated quaternary ammonium materials include Rewoquat WE15 ($C_{10}$–$C_{20}$ and $C_{16}$–$C_{18}$ unsaturated fatty acid reaction products with triethanolamine dimethyl sulphate quaternised 90% active) and Rewoquat WE18 (partially hardened tallow quaternary ester of triethanolamine) both ex Witco Corporation, Varisoft WE16 (ex Goldschmidt) and Stepantex VK90 (ex Stepan).

When unsaturated hydrocarbyl chains are present, it is preferred that the cis:trans weight ratio of the material is 50:50 or more, more preferably 60:40 or more, most preferably 70:30 or more, e.g. 85:15 or more.

Preferably at least 40%, more preferably 50%, most preferably 60% by weight, e.g. 70% by weight of the mixture of the softening materials comprises the fully saturated material.

The iodine value of the parent fatty acid or acyl compound is measured according to the method set out in respect of parent fatty acids in WO-Al-01/46513.

In the context of the present invention, reference to the iodine value of the quaternary ammonium material, means the iodine value of the parent fatty acid or acyl compound from which the quaternary ammonium material is derived.

The level of polyunsaturation in material (b) is preferably less than 5%, more preferably less than 2.5%, most preferably less than 1% by weight of material (b). It is preferred that substantially all unsaturation in material (b) is mono-unsaturation.

In order to achieve the desired mixture of saturated and unsaturated softening materials and unsaturated monoester component, a skilled person will readily understand that the saturated quaternary ammonium material can be mixed with an unsaturated softening material and that the iodine value and level of mono-ester quaternary ammonium component of the unsaturated quaternary ammonium material will affect the amount of unsaturated softening material that should be present in the composition.

Calculation of Unsaturated Mono-ester Linked Component of the Quaternary Ammonium Material The quantitative analysis of overall mono-ester linked component of the quaternary ammonium material (b) is carried out through the use of Quantitative $^{13}C$ NMR spectroscopy with inverse gated $^1H$ decoupling scheme, as follows:

The sample of known mass of the quaternary ammonium raw material is first dissolved in a known volume of $CDCl_3$ along with a known amount of an assay material such as naphthalene. A $^{13}C$ NMR spectrum of this solution is then recorded using both an inverse gated decoupling scheme and a relaxation agent. The inverse gated decoupling scheme is used to ensure that any Overhauser effects are suppressed whilst the relaxation agent is used to ensure that the negative consequences of the long $\tau_1$ relaxation times are overcome (i.e. adequate signal-to-noise can be achieved in a reasonable timescale).

The signal intensities of characteristic peaks of both the carbon atoms in the quaternary ammonium material and the naphthalene are used to calculate the concentration of the total mono-ester linked component of the quaternary ammonium material. In the quaternary ammonium material, the signal for calculating the concentration of the mono-ester quaternary ammonium species is represented by the carbon of the nitrogen-methyl group on the quaternary ammonium head group. The chemical shift of the nitrogen-methyl group varies slightly due to the different degree of esterification; characteristic chemical shifts for the mono-, di- and tri-ester links are 48.28, 47.97 and 47.76 ppm respectively. Any of the peaks due to the napthalene carbons that are free of interference from other components can then be used to calculate the mass of total mono-ester linked component present in the sample as follows:

$$\text{Mass}_{MQ}(\text{mg/ml})=(\text{mass}_{Naph}\times I_{MQ}\times N_{Naph}\times M_{MQ})/(I_{Naph}\times N_{MQ}\times M_{Naph})$$

where $\text{Mass}_{MQ}$=mass of mono-ester linked quaternary ammonium material of component (b) in mg/ml, $\text{mass}_{Naph}$= mass naphthalene in mg/ml, I=peak intensity, N=number of contributing nuclei and M=relative molecular mass. The relative molecular mass of naphthalene used is 128.17 and the relative molecular mass of the total mono-ester linked component of the quaternary ammonium material is taken as 526.

The weight percentage of total mono-ester linked component of quaternary ammonium material (b) in the raw material can thus be calculated:

$$\%\text{ of total mono-ester linked quaternary ammonium material in the raw material of component (b)}=(\text{mass}_{MQ}/\text{mass}_{HT\text{-}TEA})\times 100$$

where $\text{mass}_{HT\text{-}TEA}$=total mass of the quaternary ammonium material (b) and both $\text{mass}_{MQ}$ and $\text{mass}_{HT\text{-}TEA}$ are expressed as mg/ml.

For a discussion of the NMR technique, see "100 and More Basic NMR Experiments", S Braun, H-O Kalinowski, S Berger, 1st edition, pages 234–236.

For the purposes of the calculation of the monoester component of material (b), the level of polyunsaturation is assumed to be negligible and the unsaturation is assumed to occur equally between the mono-ester, di-ester and tri-ester components of material (b).

Thus, from the total monoester value of material (b) calculated as above, the amount of unsaturated mono-ester component of the quaternary ammonium material (b) can be calculated based on the iodine value of the parent fatty acid or fatty acyl compound from which material (b) is derived.

From the iodine value, the relative ratio of saturated to unsaturated hydrocarbyl chains in material (b) is simply calculated. Based on this calculation, the proportion of unsaturated mono-ester component based on the total mono-ester component of material (b) is also simply calculated.

Since saturated softening material (a) contains substantially no unsaturated chains, this does not affect the total amount of unsaturated mono-ester component of the quaternary ammonium material present.

The percentage by weight of the unsaturated mono-ester component of the quaternary ammonium material (b) is then calculated by dividing the result obtained above (for the unsaturated mono-ester component) by the total amount of quaternary ammonium materials (a) and (b).

For instance, pure oleic acid (C18 acid having 100% unsaturation) is taken to have an iodine value of about 90. Thus, if material (b) is derived from a C18 acid having an iodine value of 30, about ⅓ of the chains are unsaturated.

If the total mono-ester component calculation (as described above) resulted in a mono-ester component of 42 wt % of material (b), the total unsaturated mono-ester component of material (b) would be ⅓ of 42, i.e. 14%. If materials (a) and (b) are provided in a weight ratio of 1:1, the total mono-ester component of unsaturated material (b) based on the total weight of materials (a) and (b) would be 7%.

The combined softening materials are preferably present in an amount of from 10 to 80% by weight of the total composition, more preferably from 11 to 70%, most preferably from 12 to 60% by weight, e.g. from 15 to 45% by weight.

Fatty Alcohol

Optionally and advantageously, one or more un-alkoxylated fatty alcohols are present in the composition.

Preferred alcohols have a hydrocarbyl chain length of from 10 to 22 carbon atoms, more preferably 11 to 20 carbon atoms, most preferably 15 to 19 carbon atoms.

The fatty alcohol may be saturated or unsaturated, though saturated fatty alcohols are preferred as these have been found to deliver greater benefits in terms of stability, especially low temperature stability.

Suitable commercially available fatty alcohols include tallow alcohol (available as Hydrenol S3, ex Sidobre Sinnova, and Laurex CS, ex Clariant).

The fatty alcohol content in the compositions is from 0 to 10% by weight, more preferably from 0.005 to 5% by weight, most preferably from 0.01 to 3% by weight, based on the total weight of the composition.

It is particularly preferred that a fatty alcohol is present if the composition is concentrated, that as if more than 8% by weight of the cationic softening agent is present in the composition.

Nonionic Surfactant

It is preferred that the compositions further comprise a nonionic surfactant. Typically these can be included for the purpose of stabilising the compositions, Suitable nonionic surfactants include addition products of ethylene oxide and/or propylene oxide with fatty alcohols, fatty acids and fatty amines.

Any of the alkoxylated materials of the particular type described hereinafter can be used as the nonionic surfactant.

Suitable surfactants are substantially water soluble surfactants of the general formula:

$$R—Y—(C_2H_4O)_z—C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula for the alkoxylated nonionic surfactant, Y is typically;

—O—, —C(O)O—, —C(O)N(R)— or —C(O)N(R)R— in which R has the meaning given above or can be hydrogen; and Z is preferably from 8 to 40, more preferably from 10 to 30, most preferably from 11 to 25, e.g. 12 to 22.

The level of alkoxylation, Z, denotes the average number of alkoxy groups per molecule.

Preferably the nonionic surfactant has an HLB of from about 7 to about 20, more preferably from 10 to 18, e.g. 12 to 16.

Examples of nonionic surfactants follow. In the examples, the integer defines the number of ethoxy (EO) groups in the molecule.

A. Straight-chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention.

Exemplary ethoxylated primary alcohols useful herein as the viscosity/dispersibility modifiers of the compositions are $C_{18}$ EO(10); and $C_{18}$ EO(11). The ethoxylates of mixed natural or synthetic alcohols in the "tallow" chain length range are also useful herein. Specific examples of such materials include tallow alcohol-EO(11), tallow alcohol-EO (18), and tallow alcohol-EO (25), coco alcohol-EO(10), coco alcohol-EO(15), coco alcohol-EO(20) and coco alcohol-EO(25).

B. Straight-chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity and/or dispersibility modifiers in the context of this invention. Exemplary ethoxylated secondary alcohols useful herein as the viscosity and/or dispersibility modifiers of the compositions are: $C_{16}$ EO(11); $C_{20}$ EO(11); and $C_{16}$ EO(14).

C. Alkyl Phenol Alkoxylates

As in the case of the alcohol alkoxylates, the hexa- to octadeca-ethoxylates of alkylated phenols, particularly monohydric alkylphenols, having an HLB within the range recited herein are useful as the viscosity and/or dispersibility modifiers of the instant compositions. The hexa- to octadeca-ethoxylates of p-tri-decylphenol, m-pentadecylphenol, and the like, are useful herein. Exemplary ethoxylated alkylphenols useful as the viscosity and/or dispersibility modifiers of the mixtures herein are: p-tridecylphenol EO(11) and p-penradecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

D. Olefinic Alkoxylates

The alkenyl alcohols, both primary and secondary, and alkenyl phenols corresponding to those disclosed immediately hereinabove can be ethoxylated to an HLB within the range recited herein and used as the viscosity and/or dispersibility modifiers of the instant compositions.

E. Branched Chain Alkoxylates

Branched chain primary and secondary alcohols which are available from the well-known "OXO" process can be ethoxylated and employed as the viscosity and/or dispersibility modifiers of compositions herein.

F. Polyol Based Surfactants

Suitable polyol based surfactants include sucrose esters such sucrose monooleates, alkyl polyglucosides such as stearyl monoglucosides and stearyl triglucoside and alkyl polyglycerols.

The above nonionic surfactants are useful in the present compositions alone or in combination, and the term "nonionic surfactant" encompasses mixed nonionic surface active agents.

The nonionic surfactant is present in an amount from 0.01 to 10%, more preferably 0.1 to 5%, most preferably 0.35 to 3.5%, e.g. 0.5 to 2% by weight, based on the total weight of the composition.

Perfume

The compositions of the invention preferably comprise one or more perfumes.

It is well known that perfume is provided as a mixture of various components. Suitable components for use in the perfume include those described in "Perfume and Flavor Chemicals (Aroma Chemicals) by Steffen Arctander, published by the author 1969 Montclait, N.J. (US), reprinted 1st Apr. 1982 library of Congress Catalog Number 75-91398.

The perfume is preferably present in an amount from 0.01 to 10% by weight, more preferably 0.05 to 5% by weight, most preferably 0.5 to 4.0% by weight, based on the total weight of the composition, Liquid Carrier The liquid carrier employed in the instant compositions is at least partly water due to its low cost, relative availability, safety, and environmental compatibility. The level of water in the liquid carrier is more than about 50%, preferably more than about 80%, more preferably more than about 85%, by weight of the carrier. The level of liquid carrier is greater than about 50%, preferably greater than about 65%, more preferably greater than about 70%. Mixtures of water and a low molecular weight, e.g. <100, organic solvent, e.g. a lower alcohol such as ethanol, propanol, isopropanol or butanol are useful as the carrier liquid. Low molecular weight alcohols including monohydric, dihydric (glycol, etc.) trihydric (glycerol, etc.), and polyhydric (polyols) alcohols are also suitable carriers for use in the compositions of the present invention.

Co-active Softeners

Co-active softeners for the cationic surfactant may also be incorporated in an amount from 0.01 to 20% by weight, more preferably 0.05 to 10%, based on the total weight of the composition. Preferred co-active softeners include fatty esters, and fatty N-oxides.

Preferred fatty esters include fatty monoesters, such as glycerol monostearate (hereinafter referred to as "GMS"). If GMS is present, then it is preferred that the level of GMS in the composition is from 0.01 to 10% by weight, based on the total weight of the composition.

The co-active softener may also comprise an oily sugar derivative. Suitable oily sugar derivatives, their methods of manufacture and their preferred amounts are described in WO-A1-01/46361 on page 5 line 16 to page 11 line 20, the disclosure of which is incorporated herein.

Polymeric Viscosity Control Agents

It is useful, though not essential, if the compositions comprise one or more polymeric viscosity control agents. Suitable polymeric viscosity control agents include nonionic and cationic polymers, such as hydrophobically modified cellulose ethers (e.g. Natrosol Plus, ex Hercules), cationically modified starches (e.g. Softgel BDA and Softgel BD, both ex Avebe). A particularly preferred viscosity control agent is a copolymer of methacrylate and cationic acrylamide available under the tradename Flosoft 200 (ex SNF Floerger).

Nonionic and/or cationic polymers are preferably present in an amount of 0.01 to 5 wt %, more preferably 0.02 to 4 wt %, based on the total weight of the composition.

Further Optional Ingredients

Other optional nonionic softeners, bactericides, soil-releases agents may also be incorporated in the compositions of the invention.

The compositions may also contain one or more optional ingredients conventionally included in fabric conditioning compositions such as pH buffering agents, perfume carriers, fluorescers, colourants, hydrotropes, antifoaming agents, antiredeposition agents, polyelectrolytes, enzymes, optical brightening agents, pearlescers, anti-shrinking agents, anti-wrinkle agents, anti-spotting agents, antioxidants, sunscreens, anti-corrosion agents, drape imparting agents, preservatives, anti-static agents, ironing aids and dyes.

Particularly preferred examples of compositions within the scope of the invention include a composition comprising (1) from 12–16 wt % of the combination of materials (a) and (b) wherein the weight ratio of (a):(b) is from 3:2 to 2:3;

(2) 0.05 to 0.2 wt % of a fatty acid;

(3) 0.01 to 0.2 wt % of an aldehyde;

(4) 0.01 to 0.4 wt % of an inorganic electrolyte;
(5) 0.1 to 1.5 wt % perfume; and
(6) the balance of water and a composition comprising (1) from 18–24 wt % of the combination of materials (a) and (b) wherein the weight ratio of (a):(b) is from 3:2 to 2:3;
(2) 0.05 to 0.2 wt % of a fatty acid;
(3) 0.01 to 0.2 wt % of an aldehyde;
(4) 0.01 to 0.4 wt % of an inorganic electrolyte;
(5) 0.1 to 1.5 wt % perfume; and
(6) the balance of water Product Form The product may be a liquid or solid. Preferably the product is a liquid which, in its undiluted state at ambient temperature, comprises an aqueous liquid, preferably an aqueous dispersion of the cationic softening material.

Composition pH

When the product is an aqueous liquid, it preferably has a pH of greater than 1.5 and less than 5, more preferably greater than 2 and less than 4.5.

Product Use

The composition is preferably used in the rinse cycle of a home textile laundering operation, where, it may be added directly in an undiluted state to a washing machine, e.g. through a dispenser drawer or, for a top-loading washing machine, directly into the drum. Alternatively, it can be diluted prior to use. The compositions may also be used in a domestic hand-washing laundry operation.

It is also possible, though less desirable, for the compositions of the present invention to be used in industrial laundry operations, e.g. as a finishing agent for softening new clothes prior to sale to consumers.

EXAMPLES

The invention will now be illustrated by the following non-limiting examples. Further modifications will be apparent to the person skilled in the art.

All values are % by weight of the active ingredient unless stated otherwise.

The following samples were made by co-melting a fully hardened grade of a quaternary ammonium material (having an iodine value of less than 1) with a fully unsaturated grade of a quaternary ammonium material (having an iodine value of greater than 30) and adding to water with low shear agitation. The mixture was then allowed to cool. 0.68% perfume was added at 40° C. during the cooling stage and 0.25% by weight calcium chloride was added once the mixture had cooled.

TABLE 1

| Sample | Wt % AHT-1[1] | Wt % AOT-1[2] | Unsaturated Monoester Quaternary Ammonium Material[3] |
|---|---|---|---|
| 1 | 0 | 27.5 | 41 |
| 2 | 12.94 | 13.75 | 20.5 |
| 3 | 18.23 | 8.125 | 12 |
| 4 | 20.82 | 5.36 | 8 |
| 5 | 22.12 | 4.02 | 6 |
| 6 | 23.41 | 2.68 | 4 |
| 7 | 24.59 | 1.34 | 2 |
| 8 | 25.88 | 0 | 0 |

[1]di-hardened tallow ester of triethanol ammonium methyl sulphate 85% active in 15% IPA solvent (ex Kao Corporation).
[2]oleic ester of triethanol ammonium methyl sulphate 80% active in 20% DPG solvent (ex Kao Corporation).

TABLE 1-continued

| Sample | Wt % AHT-1[1] | Wt % AOT-1[2] | Unsaturated Monoester Quaternary Ammonium Material[3] |
|---|---|---|---|

[3]The amount of monoester quaternary ammonium material derived from any unsaturated softening material present. Measured by NMR and iodine value calculations according to the methodology described above. The value represents the amount as a percentage of the total fabric softening active present in the sample.

In the preceding table, wt % denotes the total % by weight of the raw material as supplied (including solvent).

Stability Evaluation

The samples were evaluated for initial viscosity and viscosity upon storage. The results are given below.

TABLE 2

| Sample | 1 | 2 | 3 | 4 | 5 | 6 | 7 | 8 |
|---|---|---|---|---|---|---|---|---|
| Initial | 37 | 30 | 42 | 100 | 113 | 88 | 87 | 89 |
| 1 week at 20° C. | 27 | 22 | 36 | 70 | 101 | 98 | 121 | 225 |
| 4 weeks at 20° C. | — | — | 35 | 93 | 114 | 112 | 147 | 232 |
| 1 week at 37° C. | 17 | 22 | 45 | 85 | 125 | 108 | 138 | 195 |
| 4 week at 37° C. | — | — | 42 | 88 | 105 | 124 | 133 | 243 |
| 1 week at 41° C. | 15 | 23 | 53 | 102 | 118 | 133 | 143 | 226 |
| 4 week at 41° C. | — | — | 40 | 88 | 120 | 141 | 152 | 203 |

Results are given as mPa.s measured on a Haake Rotoviscometer NV1 at 25° C. and a shear rate of 106 $s^{-1}$.

The results show that where the level of unsaturated monoester quaternary ammonium material is less than 4% by weight of the total amount of fabric softening active ingredients, the compositions thicken undesirably upon storage and where more than 12% by weight of the monoester component is present, the compositions are undesirably thin.

The following samples were prepared and monitored for viscostability over an extended period to evaluate long term stability at various storage temperatures. All samples were prepared by co-melting the quaternary ammonium materials, mixing with hot water, adding perfume (0.68% by weight) during cooling and postdosing calcium chloride (0.25% by weight for samples 9, 10 and 11 and 0.35% by weight for sample 12).

TABLE 3

| Sample | Wt % AHT-1 | Wt % L190[1] | Unsaturated Monoester Quaternary Ammonium Material[2] |
|---|---|---|---|
| 9 | 19.41 | 6.11 | 3.9 |
| 10 | 17.25 | 8.15 | 5.2 |
| 11 | 12.94 | 12.22 | 7.8 |
| 12 | 19.41 | 6.11 | 3.9 |

[1]partially hardened tallow ester of triethanol ammonium methyl sulphate 90% active in 10% IPA solvent.
[2]see note "3" in table 1.

In the preceding table, wt % denotes the total % by weight of the raw material as supplied (including solvent).

The results are given in the table below.

TABLE 4

| Sample | 9 | 10 | 11 | 12 |
|---|---|---|---|---|
| Initial | 63 | 53 | 51 | 52 |
| 1 week at 4° C. | 155 | 122 | 70 | 157 |
| 4 weeks at 4° C. | 165 | 120 | 75 | 160 |
| 8 weeks at 4° C. | 168 | 121† | 94 | — |

TABLE 4-continued

| Sample | 9 | 10 | 11 | 12 |
|---|---|---|---|---|
| 1 week at 20° C. | 67 | 47 | 37 | 140 |
| 4 week at 20° C. | 83 | 56 | 44 | 157 |
| 8 week at 20° C. | 99 | 66† | 60 | — |
| 1 week at 41° C. | 60 | 52 | 44 | 138 |
| 4 week at 41° C. | 73 | 55 | 46 | 210 |
| 8 week at 41° C. | 277 | 151† | 55 | — |

†measurements taken after 6 weeks at the respective temperatures.

The viscosity results are mPa.s measured on a Haake Rotoviscometer NV1 at 25° C. and a shear rate of 106 $s^{-1}$.

The results demonstrate that viscosity stability is achieved by samples 10 and 11 whereas samples 9 and 12 are unstable at both reduced and elevated temperatures.

Softening Evaluation

Samples 1, 3 and 8 were evaluated for softening performance by adding an amount of each sample corresponding to 2.22 g of the fabric softening compound to 1 liter of Wirral tap water, at ambient temperature in a tergotometer. Three pieces of terry towelling (8 cm×8 cm, 40 g total weight) were added to the tergotometer pot. The cloths were treated for 5 minutes at 65 rpm, spin dried to remove excess liquor and line dried overnight and conditioned at 21° C./65° relative humidity for 24 hours.

Softening of the fabrics was assessed by an expert panel of 4 people using a round robin paired comparison test protocol. Each panel member assessed four sets of test cloths. Each set of test cloths contained one cloth of each test system under a evaluation.

For the "ranking" vote type, panel members were asked to assess softness on a 8 point scale. Softness scores were calculated using an "Analysis of Variance" technique. Lower values are indicative of better softening.

For the "preference" vote type, the result denotes the number of votes cast during the round robin paired comparison exercise. Hence, larger results indicate greater preference.

The results are shown in the table below.

TABLE 5

| Sample | Vote Type | Test 1 | Test 2 | Test 3 | Average |
|---|---|---|---|---|---|
| 1 | Preference | 5 | 6 | 6 | 5.67 |
| 1 | Ranking | 5.5 | 5.5 | 6 | 5.67 |
| 3 | Preference | 25 | 31 | 31 | 29 |
| 3 | Ranking | 4.0 | 4.5 | 4 | 4.17 |
| 8 | Preference | 18 | 11 | 11 | 13.33 |
| 8 | Ranking | 5.75 | 4.75 | 5.75 | 5.42 |

Surprisingly, the softening performance of the composition of the invention (sample 3) is superior not only to the highly unsaturated softening composition (sample 1) but also to the fully saturated softening composition (sample 8). This is particularly unexpected as typically more saturated softening materials are known to provide better softening performance than more unsaturated softening material.

What is claimed is:

1. A concentrated, aqueous fabric softening composition comprising:

(a) an ester-linked quaternary ammonium fabric softening material comprising at least one mono-ester linked component and at least one tri-ester linked component, the material being derived from fatty groups having an iodine value of from 0 to 3; and (b) an ester-linked quaternary ammonium fabric softening material comprising at least one mono-ester linked component and at least one tri-ester linked component, the material being derived from fatty groups having an iodine value of from 20 to 140, wherein the total amount of unsaturated monoester component of material (b) is from 4 to 20% by weight of the total amount of (a) and (b).

2. A composition as claimed in claim 1 wherein materials (a) and (b) are both represented by the formula:

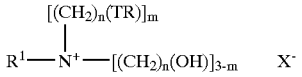

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group,

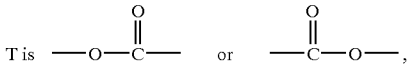

n is O or a number selected from 1 to 4 m is 1, 2 or 3 and denotes the number of moieties to which it relates that pend directly from the N atom, and $X^-$ is an anionic group, such as halides or alkyl sulphates, e.g. chloride, methyl sulphate or ethyl sulphate.

3. A composition as claimed in claim 1 wherein the total amount of materials (a) and (b) is from 10 to 80% by weight, based on the total weight of the composition.

4. A composition as claimed in claim 1 wherein at least 40% by weight the mixture of the softening materials comprises the material (a).

5. A composition as claimed in claim 1 wherein the cis:trans weight ratio of the unsaturated hydrocarbyl chains in material (b) is 50:50 or more.

6. A composition as claimed in claim 1 wherein the fatty groups from which material (b) is derived have an iodine value of from 30 to 60.

7. A composition as claimed in claim 1 wherein the total amount of unsaturated monoester component of material (b) is from 7 to 14% by weight of the total amount of (a) and (b).

8. A composition as claimed in claim 1 further comprising an aqueous carrier and an inorganic electrolyte.

9. A composition as claimed in claim 1 comprising (1) from 12–16 wt % of the combination of materials (a) and (b) wherein the weight ratio of (a):(b) is from 3:2 to 2:3;

(2) 0.05 to 0.2 wt % of a fatty acid;

(3) 0.01 to 0.2 wt % of an aldehyde;

(4) 0.01 to 0.4 wt % of an inorganic electrolyte;

(5) 0.1 to 1.5 wt % perfume; and (6) the balance of water.

10. A composition as claimed in claim 1 comprising (1) from 18–24 wt % of the combination of materials (a) and (b) (b) wherein the weight ratio of (a):(b) is from 3:2 to 2:3;

(2) 0.05 to 0.2 wt % of a fatty acid;

(3) 0.01 to 0.2 wt % of an aldehyde;

(4) 0.01 to 0.4 wt % of an inorganic electrolyte;

(5) 0.1 to 1.5 wt % perfume; and (6) the balance of water.

11. A method of preparing a composition as defined in claim 8 comprising co-melting materials (a) and (b), adding the co-melted ingredients to a heated aqueous seat with low shear agitation, allowing the mixture to cool and adding an inorganic electrolyte to the cooled mixture.

* * * * *